United States Patent [19]

Erdmannsdoerfer

[11] Patent Number: 5,042,249

[45] Date of Patent: Aug. 27, 1991

[54] SOOT FILTER FOR CLEANING THE EXHAUST FROM AN INTERNAL COMBUSTION ENGINE

[75] Inventor: Hans Erdmannsdoerfer, Ludwigsburg, Fed. Rep. of Germany

[73] Assignee: Filterwerk Mann & Hummel GmbH, Ludwigsburg, Fed. Rep. of Germany

[21] Appl. No.: 516,750

[22] Filed: Apr. 30, 1990

[30] Foreign Application Priority Data

May 5, 1989 [DE] Fed. Rep. of Germany ..... 3914758

[51] Int. Cl.[5] ..... F01N 3/02

[52] U.S. Cl. ..... 60/299; 55/466; 55/520; 55/DIG. 30; 60/303; 60/311; 422/171; 422/180

[58] Field of Search ..... 60/311, 303, 286, 299; 55/466, DIG. 30, 520, 524, 527; 422/171, 180

[56] References Cited

U.S. PATENT DOCUMENTS

| | | | |
|---|---|---|---|
| 4,276,066 | 7/1981 | Bly et al. | 55/287 |
| 4,324,572 | 4/1982 | Erdmannsdoerfer et al. | 55/385 |
| 4,436,535 | 3/1984 | Erdmannsdoerfer et al. | 55/96 |
| 4,478,618 | 10/1984 | Bly et al. | 55/314 |
| 4,811,559 | 3/1989 | Henkel | 60/311 |
| 4,829,766 | 5/1989 | Henkel | 60/303 |
| 4,872,889 | 10/1989 | Lepperhoff et al. | 55/267 |
| 4,897,096 | 1/1990 | Pischinger | 60/311 |

FOREIGN PATENT DOCUMENTS

| | | |
|---|---|---|
| 244061 | 11/1987 | European Pat. Off. . |
| 3007642 | 9/1981 | Fed. Rep. of Germany . |
| 3024539 | 6/1982 | Fed. Rep. of Germany . |
| 3111228 | 7/1986 | Fed. Rep. of Germany . |
| 3638203 | 5/1988 | Fed. Rep. of Germany . |
| 3712333 | 10/1988 | Fed. Rep. of Germany . |
| 3725587 | 2/1989 | Fed. Rep. of Germany . |
| 3800723 | 7/1989 | Fed. Rep. of Germany . |
| 2600907 | 1/1988 | France . |
| 2080140 | 2/1982 | United Kingdom . |

*Primary Examiner*—Douglas Hart
*Attorney, Agent, or Firm*—Foley & Lardner

[57] ABSTRACT

A soot filter has sets of three to five filter tubes disposed in a circle and axially parallel to one another, through which exhaust flows radially from the outside in during operation, composed of refractory ceramic yarn wound spool-wise to form hollow cylinders. To permit an electrical burn-off of the deposited soot with a relatively low expenditure of energy, the clearance A of all adjacent filter tubes 30 from one another amounts to 2 to 4% of the average filter tube diameter D. In each interstice 36 formed by at least three filter tubes 30 an elongated electrical heating element 37 is disposed which can be turned on if the exhaust gas stream is interrupted by shutting down the internal combustion engine or by diverting the exhaust gas stream away from a set of filter tubes.

10 Claims, 1 Drawing Sheet

SOOT FILTER FOR CLEANING THE EXHAUST FROM AN INTERNAL COMBUSTION ENGINE

BACKGROUND OF THE INVENTION

This invention relates to a soot filter for cleaning the exhaust from an internal combustion engine, comprising sets of, for example three to five, filter tubes disposed in a circle axially parallel to one another, closed at one end and provided at the other end with a clean gas outlet opening, and composed of refractory ceramic yarn wound spool-wise to form hollow cylinders through which exhaust flows radially from the outside in, and a filter housing which has at least one inlet chamber at the closed ends of the filter tubes and at least one clean-gas manifold chamber at the other ends into which the clean gas outlet openings lead.

Such a soot filter is described in German Patent No. DE 30 07 642. No mention is made therein, however, of the possibility of cleaning such filters by burning off the soot collected in the filter core.

A variety of methods are known for burning off soot from the filter inserts of soot filters. These include the elimination of the soot by microwaves (German Patent No. DE 30 24 539), by providing an igniter and delivering fuel in which case the filter can be divided and cleaned alternately (German Published Application No. DE 37 25 587), by applying ignition adjuvants to the collected soot so as to reduce its flash point (German Patent No. DE 31 11 228), and by heating with electrical energy (German Published Application No. DE 37 12 333). The present invention relates to this last-mentioned type of cleaning filter tubes with electrical energy.

SUMMARY OF THE INVENTION

It is the object of the present invention to provide a soot filter which can be cleaned in an improved manner.

Another object of the invention is to provide a soot filter which can be cleaned in an energy efficient manner.

A further object of the invention is to provide a soot filter which can be manufactured in an economical manner.

These and other objects of the invention are achieved by providing a soot filter for cleaning an exhaust gas stream of an internal combustion engine comprising a plurality of axially parallel filter tubes arranged in a circle in a filter housing, the tubes being formed of refractory ceramic yarn wound to form hollow cylinders through which exhaust flows radially inwardly, the tubes each being closed at one end and provided at its other end with a clean gas outlet opening, the filter housing having at least one inlet chamber into which the closed ends of the filter tubes project and at least one clean-gas manifold chamber in communication with the clean gas outlet openings of the tubes, wherein adjacent tubes are spaced apart a distance which corresponds to from about 2 to about 4% of the average outside diameter of the filter tubes, and wherein an elongated electrical heating element is disposed in each interstice formed by at least three filter tubes, and means are provided for energizing the electrical heating element when the exhaust gas stream through the filter tubes is interrupted.

It is proposed in accordance with the invention that the clearance between all adjacent filter tubes be made to amount to 2 to 4% of the average filter tube outside diameter, and that an electrical heating element be disposed in each interstice formed by at least three filter tubes, which element can be energized upon interruption of the exhaust stream produced by the shutting down the internal combustion engine or by cutting out sets of filter tubes.

In such an arrangement of filter tubes situated at relatively small distances apart and with the heating elements disposed in the interstices, good thermal insulation is provided by the filter tubes themselves surrounding the heating elements. Once the burn-off of the accumulated soot has been initiated by the closely positioned electrical heating elements upon interruption of the exhaust gas stream, the soot continues to burn away by itself on the rest of the filter tube surfaces.

Advantageously, the burn-off of the accumulated soot is promoted by providing a system for supplying a small amount of air, amounting to 2 to 6%, preferably 4%, of the full-load rate of flow of the exhaust, into the inlet chamber so as to burn off the soot when the exhaust is interrupted.

In one preferred embodiment a simple construction is achieved by making this system to comprise a blower.

Burning off the soot also at places remote from the heating elements is advantageously promoted by covering the ceramic yarn from which the filter elements are made with a catalytic material, such as copper oxide or iron oxide for example, which promotes the oxidation of the accumulated soot.

The spacing of the filter tubes and use of a single heating element to initiate combustion of soot on a plurality of filter tubes enables the soot to be burned off the tubes in an effective and energy efficient manner. Effectiveness and energy efficiency are further enhanced if a controlled air supply system is provided and/or if a catalytic material is used on the filter yarn. At the same time, the relatively simple structure of the soot filter of the invention enables the soot filter to be manufactured at comparatively low cost.

BRIEF DESCRIPTION OF THE DRAWINGS

The invention will be explained in further detail below with reference to preferred embodiments illustrated in the accompanying drawings, in which.

DETAILED DESCRIPTION OF PREFERRED EMBODIMENTS

Figure 1:
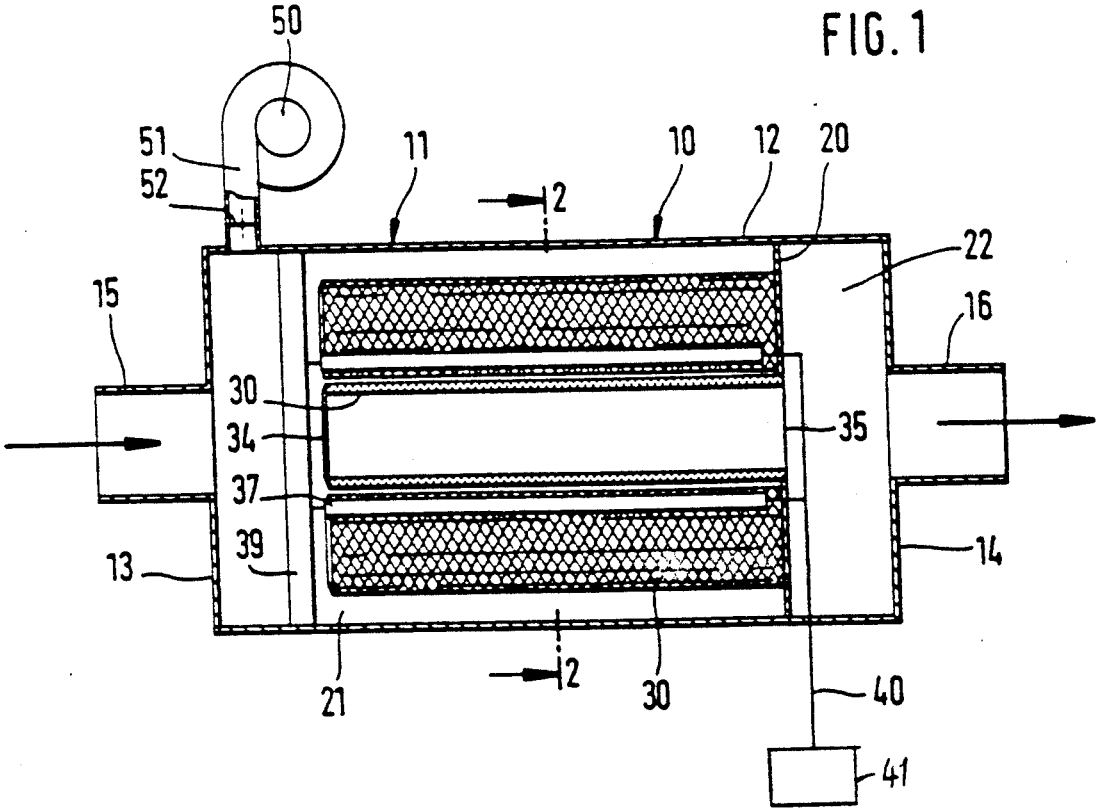
FIG. 1 shows a longitudinal section through a soot filter according to the invention.

FIG. 1 depicts a soot filter 10 comprising a cylindrical filter housing 11 having a housing periphery 12, a base 13 and a cover 14. A connection 15 carries the exhaust gases from an internal combustion engine (not shown) through the base 13. A discharge connection 16 extends out from the cover 14. Cleaned exhaust gases exit through this discharge connection into the open air. A transverse wall 20 divides the interior of the filter housing 11 into an inlet chamber 21 and a clean gas manifold chamber 22.

Filter tubes 30 affixed to the transverse wall 20 are formed of refractory ceramic yarn whose surface is roughened, which is wound coil-wise to form hollow cylinders. The filter tubes 30 are combined in sets such that three (FIG. 2), four (FIG. 3), or five (FIG. 4) tubes are arranged with their axes in a circle 31, 32, 33. Furthermore, the filter tubes 30 are arranged axially parallel to one another. Each tube 30 is closed at its one end that projects into the inlet chamber 21 by an end disk 34. At the opposite ends which are affixed to transverse wall 20, the filter tubes 30 have clean gas outlet openings 35 which open into the clean gas manifold chamber 22.

The filter tubes 30 are so arranged that the clearance A between all adjacent filter tubes amounts to from about 2 to 4%, preferably about 3%, of the average outside diameter D of the filter tubes.

Figure 2:
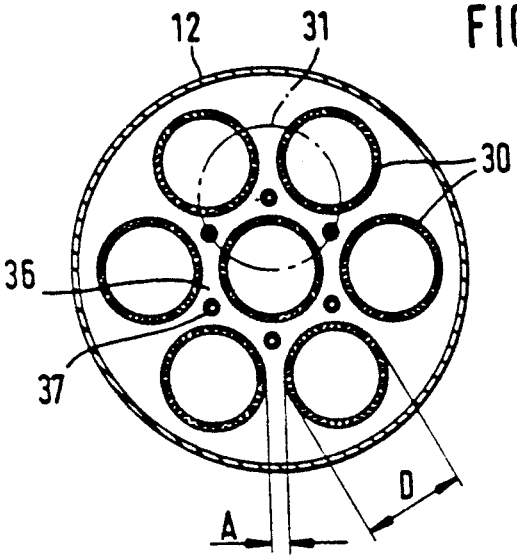
FIG. 2 is a sectional view taken along line 2—2 of FIG. 1.

In the embodiment illustrated in FIGS. 1 and 2, an elongated electrical heating element 37 is disposed in each interstice 36 formed by three filter tubes 30. At the end adjacent the inlet connection 15 the heating elements 37 are fastened to a grid 39, and at the end adjacent the discharge connection 16 they are fastened to the transverse wall 20. Means are provided for energizing the heating elements comprising an electrical feeder 40 connected to a controller 41.

Figure 3:
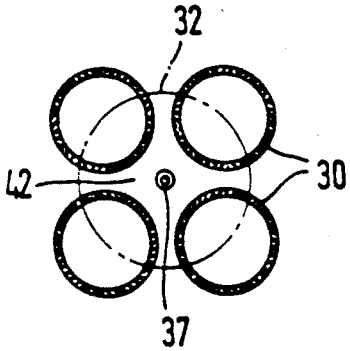
FIG. 3 shows another arrangement of the filter tubes.
Figure 4:
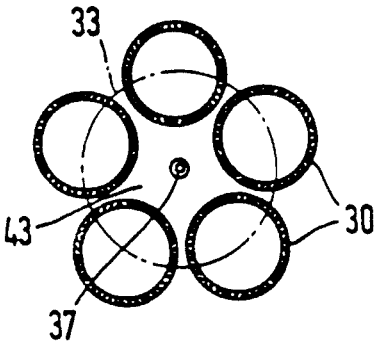
FIG. 4 shows a soot filter with a modified arrangement of the filter tubes.

In the embodiment in FIG. 3, the interstice 42 is formed by four filter tubes, and in the embodiment in FIG. 4 the interstice 43 is formed by five filter tubes. As in the embodiment in FIGS. 1 and 2, the distance between adjacent filter tubes 30 amounts to from about 2 to about 4%, preferably about 3%, of the average outside diameter of the filter tubes. In the interstices 42 and 43, an elongated electrical heating element 37 is likewise disposed.

As can be seen in FIG. 1, an air supply system is provided. The air supply system comprises a blower 50 which is in communication with the inlet chamber 21 through an inlet passage 51. A shut-off damper 52 is disposed in the inlet passage 51 so as to be able to open or close the inlet passage. The blower is so designed that, when the shut-off damper 52 is open, it can deliver an amount of air corresponding to approximately 2 to 6%, preferably about 4%, of the full-load flow of exhaust gas stream from the internal combustion engine.

To promote the oxidation of the collected soot, the ceramic yarn is coated with a catalyst, preferably copper oxide or iron oxide, most preferably copper oxide.

When the internal combustion engine is running, the exhaust gases flow through the inlet connection 15 into the inlet chamber 21 of the soot filter 10, pass radially inwardly through the filter cylinders, and exit the soot filter 10 through the discharge connection 16 after flowing through the clean gas outlet openings 35 and the clean gas manifold chamber 22. The shut-off damper 52 is closed. As the exhaust gases pass through the filter tubes 30, soot particles settle on the surfaces of the tubes. When the accumulated layer of soot has reached a given thickness and the resistance to flow has consequently risen to a predetermined level, power is delivered by a suitable controller 41 through the electric feeder 40 to the heating elements 37 when the internal combustion engine is stopped. The heating elements 37 heat up, and through the air surrounding them they also heat the coating of soot on the filter tubes 30, which are already hot from the previous operation of the internal combustion engine. Finally the soot layer begins to burn away beginning at the areas closest to the heating elements 37. To support this process the blower system 50 is turned on with the heating elements 37 and, with the shut-off damper 52 open, delivers a controlled flow of air amounting to from 2 to 6%, preferably about 4%, of the full-load exhaust flow of the internal combustion engine through the inlet chamber 21 and through the filter tubes 30.

Instead of shutting down the internal combustion engine, provision can also be made for shunting out sets of filter tubes by means of appropriately disposed shut-off dampers. For example, two of the soot filters 10 illustrated in FIGS. 1 and 2 can be provided, and the exhaust gas stream flowing from the internal combustion engine can be shunted or diverted by a valve system away from one of the filters to the other filter while deposited soot is burned off the one filter.

The foregoing description and examples have been set forth merely to illustrate the invention and are not intended to be limiting. Since modifications of the described embodiments incorporating the spirit and substance of the invention may occur to persons skilled in the art, the scope of the invention should be construed to include all modifications falling within the ambit of the appended claims and equivalents thereof.

What is claimed is:

1. A soot filter for cleaning an exhaust gas stream of an internal combustion engine, said filter comprising a plurality of axially parallel filter tubes arranged in a circle in a filter housing, said tubes being formed of refractory ceramic yarn wound to form hollow cylinders through which exhaust flows radially inwardly, said tubes each being closed at one end and provided at its other end with a clean gas outlet opening, said filter housing having at least one inlet chamber into which the closed ends of the filter tubes project and at least one clean-gas manifold chamber in communication with the clean gas outlet openings of said tubes, wherein adjacent tubes are spaced apart a distance (A) which corresponds to from about 2 to about 4% of the average outside diameter (D) of the filter tubes, and wherein an elongated electrical heating element (37) is disposed in each interstice (36, 42, 43) formed by at least three filter tubes (30), and means are provided for energizing said electrical heating element when the exhaust gas stream through said filter tubes is interrupted.

2. A soot filter according to claim 1, further comprising means (50) for supplying air into said inlet chamber (21) for burning off soot when exhaust gas stream is interrupted.

3. A soot filter according to claim 2, wherein said air supplying means supplies an amount of air corresponding to from 2 to 6% of the full-load exhaust gas stream.

4. A soot filter according to claim 3, wherein said air supplying means supplies an amount of air corresponding to about 4% of the full-load exhaust gas stream.

5. A soot filter according to claim 2, wherein said air supply means (50) comprises a blower.

6. A soot filter according to claim 1, wherein said ceramic yarn is coated with a catalytic material which promotes oxidation of accumulated soot.

7. A soot filter according to claim 6, wherein said catalytic material is selected from the group consisting of copper oxide and iron oxide.

8. A soot filter according to claim 1, wherein said filter tubes are arranged in sets each comprising from three to five filter tubes.

9. A soot filter according to claim 1, wherein said means for energizing said electrical heating element is activated when the flow of exhaust gas through said filter tubes is interrupted by turning off the internal combustion engine.

10. A soot filter according to claim 1, wherein said means for energizing said electrical heating element is activated when the flow of exhaust gas through said filter tubes is interrupted by diverting the flow of exhaust gas to an alternate filter.

* * * * *